US012311422B2

(12) United States Patent
Kremeyer et al.

(10) Patent No.: US 12,311,422 B2
(45) Date of Patent: May 27, 2025

(54) MEASURING ROLLER FOR DETERMINING A CHARACTERISTIC OF A STRIP-SHAPED MATERIAL PASSED OVER THE MEASURING ROLLER, USE OF A MEASURING ROLLER FOR DETERMINING A CHARACTERISTIC OF A STRIP-SHAPED MATERIAL PASSED OVER THE MEASURING ROLLER, AND METHOD FOR DETERMINING THE POSITION OF A STRIP EDGE OF A STRIP-SHAPED MATERIAL

(71) Applicant: VDEh-Betriebsforschungsinstitut GmbH, Düsseldorf (DE)

(72) Inventors: Julian Kremeyer, Hilden (DE); Gert Mücke, Hilden (DE); Marcus Neuer, Düsseldorf (DE); Hagen Krambeer, Jüchen (DE)

(73) Assignee: VDEh-Betriebsforschungsinstitut GmbH, Düsseldorf (DE)

( * ) Notice: Subject to any disclaimer, the term of this patent is extended or adjusted under 35 U.S.C. 154(b) by 157 days.

(21) Appl. No.: 17/733,438

(22) Filed: Apr. 29, 2022

(65) Prior Publication Data

US 2022/0371065 A1 Nov. 24, 2022

(30) Foreign Application Priority Data

May 21, 2021 (DE) ..... 10 2021 002 661.6

(51) Int. Cl.
*B21B 38/02* (2006.01)
*B21B 38/08* (2006.01)

(52) U.S. Cl.
CPC ..... *B21B 38/02* (2013.01); *B21B 38/08* (2013.01)

(58) Field of Classification Search
CPC ..... B21B 38/02; B21B 38/08
See application file for complete search history.

(56) References Cited

U.S. PATENT DOCUMENTS

2003/0236637 A1 12/2003 Noe et al.
2009/0320616 A1* 12/2009 Noe ..... G01L 5/045 73/862.453

FOREIGN PATENT DOCUMENTS

DE 1773551 A1 7/1971
DE 2630410 C2 3/1988
(Continued)

OTHER PUBLICATIONS

Translation of DE-102017125294 (Year: 2019).*

*Primary Examiner* — Bobby Yeonjin Kim
(74) *Attorney, Agent, or Firm* — Howard IP Law Group, PC

(57) ABSTRACT

A measuring roller for determining a property of a strip-shaped material such as metal strip, passed over a measuring roller, having a measuring roller body with a circumferential surface, at least one recess in the measuring roller body, which is arranged at a distance from the circumferential surface or leads from the circumferential surface into the interior of the measuring roller body, and with a first force sensor arranged in the recess and a second force sensor arranged in the recess or in a further recess adjacent to the recess, wherein the first force sensor has a sensor surface and the first force sensor can generate a sensor signal when the position of the sensor surface of the first force sensor changes, and the second force sensor has a sensor surface and the second force sensor can generate a sensor signal when the position of the sensor surface of the second force sensor changes.

1 Claim, 12 Drawing Sheets

(56) References Cited

FOREIGN PATENT DOCUMENTS

| | | | | | |
|---|---|---|---|---|---|
| DE | 4236657 | A1 | | 5/1994 | |
| DE | 19616980 | A1 | | 10/1997 | |
| DE | 10207501 | C1 | | 10/2003 | |
| DE | 10224938 | A1 | | 1/2004 | |
| DE | 102004008303 | A1 | | 9/2005 | |
| DE | 102006029139 | A1 | | 12/2007 | |
| DE | 202007001066 | U1 | | 5/2008 | |
| DE | 102008030282 | B3 | | 10/2009 | |
| DE | 202014006820 | U1 | | 11/2015 | |
| DE | 102014012426 | A1 | | 3/2016 | |
| DE | 102017125294 | A1 | * | 5/2019 | ..... B21B 38/02 |
| EP | 1369186 | A2 | | 12/2003 | |
| EP | 3009206 | A1 | | 4/2016 | |
| JP | S6083714 | A | | 5/1985 | |
| KR | 20080058917 | A | | 6/2008 | |
| WO | 2020120328 | A1 | | 6/2020 | |

* cited by examiner

MEASURING ROLLER FOR DETERMINING A CHARACTERISTIC OF A STRIP-SHAPED MATERIAL PASSED OVER THE MEASURING ROLLER, USE OF A MEASURING ROLLER FOR DETERMINING A CHARACTERISTIC OF A STRIP-SHAPED MATERIAL PASSED OVER THE MEASURING ROLLER, AND METHOD FOR DETERMINING THE POSITION OF A STRIP EDGE OF A STRIP-SHAPED MATERIAL

CROSS REFERENCE TO RELATED APPLICATIONS

This application claims the foreign priority benefit under 35 U.S.C. 119 of German Patent Application No. 10 2021 002 661.6 filed on May 21, 2021, the disclosure of which is incorporated herein by reference.

FIELD OF THE INVENTION

The invention relates to the specific use of a measuring roller for determining a property of a strip-shaped material, in particular metal strip, passed over the measuring roller. Furthermore, the invention relates to a method for determining the position of a strip edge of a strip-shaped material relative to a reference point, a reference line or a reference plane. Likewise, the invention relates to a measuring roller for determining a property of a strip-shaped material, in particular metal strip, passed over the measuring roller.

BACKGROUND

Measuring rollers are used in the cold and hot rolling of metal strip and are known, for example, from DE 42 36 657 A1.

For the conventional measurement of flatness during strip rolling, methods are mainly used in which the strip is guided with a certain wrap angle over a measuring roller equipped with force sensors.

In this way, in the measuring roller described in DE 42 36 657 A1, contact occurs between force transducers or their covers, which are arranged in radial recesses of the measuring roller open to the measuring roller surface, and the belt. There is a cylindrical gap between the force sensors clamped at the bottom of their recess and the recess wall surrounding them. This gap can be closed with an O-ring in a shoulder-sealing manner or with a plastic layer in a front-sealing manner to prevent dirt, for example tape abrasion and lubricant, from entering the ring gaps between the force sensor and the measuring roller body. It is also possible, as shown in DE 42 36 657 A1 in FIG. 1*c*, to place the sensor in a recess in the solid roller, which is then covered with an attached membrane. The cover shown in DE 42 36 657 A1 has a round outer surface, the geometric shape of which is therefore mirror-symmetrical both with respect to a plane perpendicular to the axis of rotation and with respect to a plane containing the axis of rotation.

The arrangement of the force sensors at a distance from the surrounding wall and the closing of the annular gap with the aid of an O-ring or a sufficiently elastic plastic (DE 196 16 980 A1) prevents transverse forces acting in the body of the measuring roller during rolling from having a disturbing effect on the force sensors or the measurement result. Such disturbing forces are the result of the tape tension acting on the measuring roller and an associated deflection of the measuring roller. Its cross-section takes the form of an ellipse, the longer axis of which runs parallel to the belt. The measuring roller deflection simulates an unevenness of the belt to the force sensor when it is transmitted to the encoder by force shunt. Such a force shunt cannot be completely avoided when using a seal in the annular gap, since the sealing forces inevitably act on the force sensor. The cover shown in DE 196 16 980 A1 has a round outer surface, the geometric shape of which is therefore mirror-symmetrical both with respect to a plane perpendicular to the axis of rotation and with respect to a plane containing the axis of rotation.

DE 102 07 501 C1 describes a solid roller for detecting deviations in flatness during the treatment of strip-shaped material, in particular metal strip, with force sensors arranged in recesses, in which the force sensors are axially accessible. The axial recesses are often drilled using deep-hole drilling tools. For measuring rolls with bale widths >1000 mm, very long drilling tools must be used, since the drilling tool must first be moved over the sometimes very long journals to drill the recess on the face side.

DE 20 2007 001 066 U1 describes a measuring roller for detecting deviations in flatness during the treatment of material in strip form, in particular metal strip, with a measuring roller body and a jacket tube at least partially surrounding the measuring roller body and force sensors arranged in recesses, the recesses extending from one end face of the measuring roller into the measuring roller body and/or into the jacket tube. The recess can be closed at the front with a cover. The pins of this measuring roller, which are provided on each end face, are formed on the measuring roller body. A disadvantage of this measuring roller is the weakening of the measuring roller body or the sheath tube due to the recesses introduced. With wide measuring rollers, as with deep hole drilling, passing over the bearing journal is a major disadvantage. A further problem is the closing of the channels/grooves machined up to the end face, as these are not produced with drilling tools (round channels) as in DE 102 07 501 C1, but with milling tools (angular channels).

The measuring rollers of the prior art determine the flatness of the strip by means of individual sensors distributed over the circumference of the measuring roller. In this case, the measurement results of the individual sensors are often related to each other during evaluation in order to determine the flatness. With prior art measuring rollers, measuring errors always occur when the metal strip vibrates. This is the case, for example, when the measuring roller is located near a reel. The vibration causes the amount of force acting on the individual force sensor to no longer depend solely on the belt tension and flatness, but to be amplified or reduced by the vibration. This leads to measurement errors, especially with evaluation methods that relate the measurement results of individual sensors distributed over the circumference.

The use of a measuring roller for determining the position of the belt-shaped material or for determining the position of an edge of the belt-shaped material on the circumferential surface of the measuring roller is known for a certain measuring roller from WO 2020/120328 A. The covers shown in FIG. 7 of WO 2020/120328 each have a round outer surface whose geometric shape is thus designed to be mirror-symmetrical both with respect to a plane perpendicular to the axis of rotation and with respect to a plane containing the axis of rotation. The force sensor shown in FIG. 20 of WO 2020/120328 has a circular outer surface whose geometric shape is therefore mirror-symmetrical both with respect to a plane perpendicular to the axis of rotation and with respect to a plane containing the axis of rotation. The force sensor shown in FIG. 23 of WO 2020/120328 has a square outer surface, the geometric shape of which is therefore mirror-symmetrical both with respect to a plane perpendicular to the axis of rotation and with respect to a plane containing the axis of rotation.

From EP 3 009 206 A1 a measuring roller suitable for determining the flatness of a metal strip is known that has

- a measuring roller body with a circumferential surface,
- at least one recess in the measuring roller body,
- at least one beam disposed in the recess and extending along a longitudinal axis, and
- a first force sensor arranged in the recess and a second force sensor arranged in the recess
  - where the beam is supported within the recess on the first force sensor and the second force sensor, and where the measuring roller body extends along an axis of rotation and the longitudinal axis of the beam is not parallel to the axis of rotation of the measuring roller body but extends in a plane perpendicular to the axis of rotation of the measuring roller body. The measuring bar shown in EP 3 009 206 A1 has a rectangular outer surface, the geometric shape of which is mirror-symmetrical with respect to a plane perpendicular to the axis of rotation as well as with respect to a plane containing the axis of rotation.

SUMMARY

Against this background, the invention was based on the problem of providing better means for determining the position of a strip edge of a strip-shaped material relative to a reference point or a reference line or a reference plane.

The invention is based on the basic idea of further developing the measuring roller known from EP 3 009 206 A1 in such a way that the measuring roller can be

- a measuring roller body with a circumferential surface,
- at least one recess in the measuring roller body,
- at least one beam disposed in the recess and extending along a longitudinal axis, and
- a force sensor arranged in the recess where the beam is supported on the force sensor within the recess and where the measuring roller body extends along an axis of rotation and the longitudinal axis of the beam is not parallel to the axis of rotation of the measuring roller body and the longitudinal axis of the beam is not in a plane which is perpendicular to the axis of rotation of the measuring roller body, in order to use the measuring roller then reconstructed in this way for determining the position of a strip edge of the strip-shaped material relative to a reference point or a reference line or a reference plane when the strip-shaped material is passed over the measuring roller, and/or to perform a method for determining the position of the strip edge with this measuring roller.

Due to the fact that the longitudinal axis of the beam

- is not parallel to the axis of rotation of the measuring roller body and
- does not run in a plane perpendicular to the axis of rotation of the measuring roller body,
- the longitudinal axis of the beam is oblique to the axis of rotation and oblique to the planes perpendicular to the axis of rotation of the measuring roller body. With such an inclined beam, it is possible to determine from the progression of the force measured by the force sensor over time with which point on the beam the belt-shaped material (hereinafter also referred to as belt) first makes contact when the belt-shaped material is passed over the measuring roller and the measuring roller rotates. From the known geometry of the bar and, for example, the known position of the bar relative to the edge of the measuring roller (to one end of the measuring roller body), it is possible to calculate, for example, how far away from the edge (from one end of the measuring roller body) of the measuring roller the point on the bar with which the tape-shaped material first makes contact when the tape-shaped material is passed over the measuring roller is. This results in the position of the strip edge relative to the edge of the measuring roller (to one end of the measuring roller body), since the strip-shaped material runs onto the beam with the strip edge first.

The "longitudinal axis" of the beam is understood to be the axis in the main direction in which the beam extends. For a rectangular beam having longitudinal edges parallel to each other and side edges perpendicular to the longitudinal edges and shorter than the longitudinal edges, the longitudinal axis is the axis centered on the beam and parallel to the longitudinal edges of the rectangle. In the case of a bar which has a flat, rectangular underside which has longitudinal edges running parallel to one another and side edges running perpendicular to the longitudinal edges which are shorter than the longitudinal edges, and which has a curved upper side which is suitable for being in alignment with a cylindrical outer surface of the measuring roll body and which, when the bar is disposed in the recess, is adapted to close the gap created by the recess in the cylindrical outer surface of the measuring roller body so as to provide a closed (except for any gap around the bar) cylindrical outer surface, the longitudinal axis is the axis which is centered on the bar and parallel to the longitudinal edges of the rectangular bottom surface. In a beam having a non-planar bottom surface and a curved top surface adapted to be in alignment with a cylindrical outer surface of the measuring roller body and which, when the beam is disposed in the recess, is adapted to close the gap in the cylindrical outer surface of the measuring roller body created by the recess so as to provide a closed (except for any gap around the beam) cylindrical outer surface, cylindrical outer surface (except for any gap around the beam), and in which two end faces are provided, the bottom and the top extending from one end face to the other end face, the longitudinal axis is the line connecting a point on one end face, preferably the center of one end face, to a point on the other end face, preferably the center of the other end face. The end faces can be flat surfaces. The end faces can also be curved surfaces, for example partial surfaces of a cylinder, if the beam is not bounded by flat end faces but by rounded end faces.

In a preferred embodiment, the strip-shaped material is guided over the measuring roller in such a way and the measuring roller is rotated by the strip-shaped material guided over it and/or a drive in such a way that, viewed in the direction of rotation of the measuring roller, the end of the bar that is further out (the end of the bar that is closer to the edge of the measuring roller) is guided. In a preferred embodiment, more outer portions of the beam first come into contact with the belt-shaped material before more inner portions of the beam come into contact with the belt-shaped material.

In a preferred embodiment, the recess is a recess that extends inwardly from the circumferential surface of the measuring roller body or extends inwardly from a curved surface, preferably a cylindrical surface, that is parallel to the circumferential surface of the measuring roller body. Embodiments are possible in which the recess ends with an opening in the circumferential surface of the measuring roller body, this opening preferably being closed by the beam or by a cover arranged radially above the beam. Likewise, embodiments are possible in which the recess is closed in the final state of the measuring roller by a layer of material arranged radially outside the recess. Such a layer of material can be created by a layer coating applied to the circumferential surface of a measuring roller body semi-finished product to create the final measuring roller body. Likewise, designs are known in which a sheath tube is slid onto a measuring roller body semi-finished product, thereby closing recesses that are present in the measuring roller body semi-finished product and end with an opening in the circumferential surface of the measuring roller body semi-finished product. The wall thickness of the outer casing then determines the material layer radially outside the recess. Likewise, designs are conceivable in which recesses present in the measuring roller body semi-finished product and ending with an opening in the circumferential surface of the measuring roller body semi-finished product, the recess being closed by a cover, are closed by a coating applied to the circumferential surface of the measuring roller body semi-finished product. The material thickness of the coating then defines the material layer radially outside the recess.

In a preferred embodiment, the majority, preferably the vast majority (more than 75%), of the cross-sectional areas of the recess in planes perpendicular to a radial direction of the measuring roller have the same shape and/or size.

In a preferred embodiment, the majority, preferably the vast majority (greater than 75%), of the cross-sectional areas of the recess in the planes that run perpendicular to a radial direction of the measuring roller and cut the beam, the same shape as the bar. In a preferred embodiment, all cross-sectional areas of the recess in the planes that run perpendicular to a radial direction of the measuring roller and cut the beam, the same shape as the bar. In a preferred embodiment, the recess has the same shape but a slightly larger shape (for example, a cross-sectional area that is 1% or 2% larger in the respective plane) so that a uniform gap is formed between the beam and the boundary wall defining the recess. The gap may be filled entirely or not at all or in parts with a seal.

In a preferred embodiment, the beam has a bottom surface disposed closer to the axis of rotation of the measuring roller body and a top surface disposed further outward relative to the bottom surface in a radial direction of the measuring roller.

In a preferred embodiment, the beam is supported within the recess on a first force sensor and on a second force sensor, the first force sensor being disposed within the recess and the second force sensor being disposed within the recess. In the context of the method according to the invention, the position of the strip edge of the strip-shaped material relative to a reference point or a reference line or a reference plane of the measuring roller body of the measuring roller is determined from the measuring signal of the first force sensor and/or the measuring signal of the second force sensor.

In a preferred embodiment, the underside of the beam within the recess is supported on the first force sensor and the second force sensor. The underside can be flat. The underside may have two heels, with the heels of the underside supporting the beam on the first force sensor and the second force sensor.

In a preferred embodiment, the beam has a first end and a second end opposite the first end. In a preferred embodiment, the beam is supported by the first end on the first force sensor and by the second end on the second force sensor.

In a preferred embodiment, the top surface of the beam lies in the curved surface, preferably in the cylindrical surface, in which the circumferential surface of the measuring roller body also lies. In a preferred embodiment, the top surface of the beam lies in a curved surface, preferably a cylindrical surface, which is arranged parallel to the curved surface, preferably the cylindrical surface, in which the circumferential surface of the measuring roller body lies. However, the upper side can also be flat.

In a preferred embodiment, the top and bottom of the beam have the same cross-sectional shape. In a preferred embodiment, the top and bottom of the beam have the same cross-sectional shape and size. In a preferred embodiment, the top and bottom of the beam have the same cross-sectional shape and size and are aligned with each other. Embodiments are also possible in which the bottom side has the same cross-sectional shape as the top side, but a smaller size.

In a preferred embodiment, the measuring roller has a center plane that is perpendicular to the axis of rotation of the measuring roller body and is located midway between one end of the measuring roller body and the second end opposite the first end.

The advantages of the invention can already be achieved if the measuring roller has a single beam. In a preferred embodiment, the single beam has a first end disposed on one side of the center plane and a second end opposite the first end disposed on the opposite side of the center plane. The single bar thus crosses over the center plane in this preferred embodiment. In a preferred embodiment, the first end of the beam is located closer to the first end of the measuring roller body than to the center plane. Additionally or alternatively, in a preferred embodiment, the second end of the beam is disposed closer to the second end of the measuring roller body than to the center plane. Already with such an embodiment, the position of both edges of the strip can be determined. From the course of the force measured by the force sensor over time can be determined, when the belt hits the beam for the first time, from which the position of the first belt edge can be calculated, and when the tape runs off the beam again, from which the position of the second tape edge can be calculated.

If the position of both strip edges is known, the strip width can also be determined as the distance between the two strip edges.

The advantages of the invention can be particularly well achieved if the measuring roller has a first bar and a second bar. In a preferred embodiment, the first beam has a first end and a second end opposite the first end, the first end and the second end of the first beam being disposed on one side of the center plane. In a preferred embodiment, the second beam has a first end and a second end opposite the first end, the first end and the second end of the second beam being disposed on the opposite side of the center plane. Neither the first bar nor the second bar crosses the center plane in a preferred embodiment. In a preferred embodiment the first end of the first beam is arranged closer to the first end of the measuring roller body than to the center plane, the second end of the first beam is located closer to the center plane than the first end of the first beam, the first end of the second beam is arranged closer to the second end of the measuring roller body than to the center plane, the second end of the second beam is located closer to the center plane than the first end of the second beam, the first end of the first bar and the first end of the second bar are arranged on a line parallel to the axis of rotation of the measuring roller body.

In a preferred embodiment, the first beam and the second beam are mirror symmetrical to the center plane.

An embodiment having a first beam on one side of the center plane and a second beam on the opposite side of the center plane can be used particularly well to determine the location of one edge of the tape with the first beam and the location of the second edge of the tape with the second beam. If the position of both strip edges is known, the strip width can also be determined as the distance between the two strip edges.

Designs with more than two beams are also possible. Preferably, in these embodiments, two beams are combined into a pair of a first beam and a second beam, and preferably the first beam and the second beam of the pair are mirror symmetrical with respect to the center plane. In a preferred embodiment, a first pair is circumferentially spaced from a second pair. By increasing the number of pairs, the resolution can be increased. The more pairs are arranged on the measuring roller body in the circumferential direction, the more frequently the strip edge position is determined per revolution of the measuring roller.

The advantages of the invention can already be realized with a single force sensor in the recess, on which the beam is supported in the recess. Investigations have shown that partial overlap of the beam, as would result if the strip came to rest on the beam in such a way that the edge of the strip passes over the beam, can be determined from the signal of the single force sensor and the degree of partial overlap can also be determined so that the position of the edge of the strip on the beam and thus the position of the edge of the strip on the measuring roller can be determined.

In embodiments where only a single force sensor is provided in the recess on which the beam is supported in the recess, it is possible for the beam to be supported only on the force sensor and otherwise unsupported. Except for the support on the force sensor, the beam in this embodiment is therefore designed to float freely. In an alternative embodiment, the beam is supported on the single force sensor and still has at least one second support point on a shoulder in the recess. Preferably, in this embodiment, the beam has only two supports, once on the force sensor and once on a single support point on a shoulder in the recess.

Embodiments are also possible in which the beam is supported in the recess on more than two force sensors.

In a preferred embodiment, the longitudinal axis of the beam extends in a plane that is at an angle of from 10° to 80°, preferably from 15° to 75°, preferably from 15° to 50°, preferably from 20° to 45°, preferably from 30° to 60° to a plane containing the axis of rotation.

In a preferred embodiment, the beam is rectangular in cross-section in a plane containing or parallel to the longitudinal axis of the beam, rather than square. Embodiments are possible in which the beam is substantially rectangular in shape, but rounded at its end with semicircles. This allows for embodiments where the recess has the same cross-sectional shape as the beam to have the recess with rounded ends and no corners that are prone to cracking.

In a preferred embodiment, the beam has in the majority, preferably in the vast majority of the planes that is perpendicular to a radial direction of the measuring roller intersecting the longitudinal axis of the beam, a cross-sectional shape that is mirror symmetrical with respect to a plane containing the radial direction of the measuring roller intersecting the longitudinal direction of the beam and the longitudinal direction of the beam, and/or is mirror-symmetrical with respect to a plane containing the radial direction of the measuring roller intersecting the longitudinal direction of the beam and perpendicular to the longitudinal direction of the beam.

In a preferred embodiment, the beam has a length from its first end to its second end that is at least 5%, preferably at least 10%, preferably at least 15%, preferably at least 20%, preferably at least 30% of the longest length of the measuring roller body along a line parallel to the axis of rotation of the measuring roller body.

In particular, the beam is preferably screwed into the recess with a clamping screw. In a preferred embodiment, one clamping screw is provided per force sensor in the recess. In a preferred embodiment, the respective force sensor is ring-shaped and the clamping screw passes through the center of the ring. The clamping screw is preferably seated with its head in a groove, in particular preferably a groove corresponding to the cross-sectional shape of the head of the clamping screw, for example a circular groove or a hexagonal groove. The tensioning screw can be used to generate a preload on the force sensor. Embodiments are also possible in which the force sensor itself has a thread for the clamping screw.

With the use and method according to the invention, the position of the strip edge of the strip-shaped material relative to a reference point, a reference line or a reference plane is determined. In a preferred embodiment, the use and method according to the invention is used to determine the position of the strip edge of the strip-shaped material relative to a reference point, a reference line or a reference plane of the measuring roller. However, designs are also possible in which the use according to the invention and the method according to the invention are used to determine the position of the strip edge of the strip-shaped material relative to a reference point, a reference line or a reference plane of a system in which the measuring roller is installed, for example the vertical center plane of a roll stand or a reel. A reference point can be a point at the end of the measuring roller body. A reference line can be a line running once around the measuring roller body. A reference plane can be the plane in which one end of the measuring roller body lies. A reference plane can be the center plane.

The use of the measuring roller for determining the strip edge position as proposed in the invention can already be carried out with a measuring roller containing only the beam(s). Within the scope of the invention, it is possible to determine only the strip edge position with the measuring roller. However, within the scope of the invention, it is also possible to use the same measuring roller to measure both the position of the strip edge and the strip width (which results from the distance of one strip edge from the other strip edge) as well as other properties of the strip-shaped material, such as the flatness of the strip-shaped material or the strip tension. In a preferred embodiment, a measuring roller is used in the context of the use proposed according to the invention, which has further recesses with further force sensors in addition to the beam or beams provided according to the invention. The force sensors of the further recesses are used, for example, to determine the flatness and/or to determine the strip tension. For use according to the invention, existing measuring rolls equipped for determining flatness and/or determining strip tension can be retrofitted by additionally inserting the bar provided for according to the invention and the recess provided for it, or the bars provided for according to the invention and the recesses provided for them, into the existing measuring roll.

Therefore, the invention also proposes a measuring roller suitable for detecting a property of a strip-shaped material, in particular metal strip, passed over the measuring roller, which has a measuring roller body with a circumferential surface, at least one recess in the measuring roller body, the recess having a first cross-sectional shape, at least one beam disposed in the recess and extending along a longitudinal axis, and a first force sensor arranged in the recess where the beam is supported within the recess on the first force sensor and where the measuring roller body extends along an axis of rotation and the longitudinal axis of the beam is not parallel to the axis of rotation of the measuring roller body and the longitudinal axis of the beam does not extend in a plane perpendicular to the axis of rotation of the measuring roller body, where at least one further recess is provided in the measuring roller body, where a second force sensor is arranged in the further recess and the further recess has a second cross-sectional shape which is different from the first cross-sectional shape.

In a preferred embodiment, the cross-sectional shape of the further recess is circular.

In a preferred embodiment, the further recess is a bore running axially and thus parallel to the axis of rotation, such as one of the recesses disclosed in DE 102 07 501 C1. Several other recesses with force sensors can also be provided.

In a preferred embodiment, the further recess is a radially extending bore, which is designed, for example, like one of the recesses known from DE 42 36 657 A1. Several other recesses with force sensors can also be provided.

According to the invention, it is further proposed a measuring roller for determining a property of a strip-shaped material, in particular metal strip, which is passed over the measuring roller with a measuring roller body with a circumferential surface, at least one recess in the measuring roller body, a force sensor arranged in the recess, and a cover which at least partially closes the recess and which, viewed in the radial direction of the measuring roller body, is arranged above the force sensor, where the measuring roller body has an axis of rotation, whereby the cover has an outer surface and/or the force sensor has an outer surface and/or an intermediate piece arranged between the cover and the force sensor has an outer surface, the geometric shape of which is designed to be mirror-symmetrical with respect to a plane of symmetry containing the axis of rotation, but the geometric shape of which is not designed to be mirror-symmetrical with respect to planes perpendicular to the axis of rotation or the cover has an outer surface and/or the force sensor has an outer surface and/or an intermediate piece arranged between the cover and the force sensor has an outer surface, the geometric shape of which is designed to be mirror-symmetrical with respect to a plane of symmetry running perpendicular to the axis of rotation, but the geometric shape of which is not designed to be mirror-symmetrical with respect to planes containing the axis of rotation or the cover has an outer surface and/or the force sensor has an outer surface and/or an intermediate piece arranged between the cover and the force sensor has an outer surface, the geometric shape of which is designed to be non-mirror-symmetrical both with respect to planes which are perpendicular to the axis of rotation and with respect to planes which contain the axis of rotation.

For example, the cover, intermediate piece, and/or force sensor may have an outer surface that is triangular or polygonal but with an odd number of corners, such as pentagonal or heptagonal, or that has, for example, the shape of a trapezoid or the shape of a parallelogram.

In a preferred embodiment, no intermediate piece is provided between the cover and the force sensor, so that the invention is realized in that the cover has an outer surface and/or the force sensor has an outer surface whose geometric shape is mirror-symmetrical with respect to a symmetry plane containing the axis of rotation, but whose geometric shape is not mirror-symmetrical with respect to planes perpendicular to the axis of rotation or the cover has an outer surface and/or the force sensor has an outer surface whose geometric shape is mirror-symmetrical with respect to a plane of symmetry that runs perpendicular to the axis of rotation, but whose geometric shape is not mirror-symmetrical with respect to planes that contain the axis of rotation or the cover has an outer surface and/or the force sensor has an outer surface whose geometric shape is not mirror-symmetrical both with respect to planes perpendicular to the axis of rotation and with respect to planes containing the axis of rotation.

In a preferred embodiment, the cover extends along a longitudinal axis, and in a particularly preferred embodiment, the outer surface is not mirror symmetrical to a plane containing the longitudinal axis.

In a preferred embodiment, the force sensor extends along a longitudinal axis, and in a particularly preferred embodiment, the outer surface is not mirror symmetrical to a plane containing the longitudinal axis.

In a preferred embodiment, an intermediate member disposed between a cover and the force sensor extends along a longitudinal axis, and in a particularly preferred embodiment, the outer surface is not mirror symmetrical with respect to a plane containing the longitudinal axis.

In a preferred embodiment, a clamping screw is provided, the head of which is arranged in a groove of the cover and which is screwed to the bottom of the recess. In particular, the force sensor is preferably annular and the clamping screw passes through the force sensor.

It has been recognized that by shaping the outer surface of the cover and/or of the force sensor and/or—if present—of the intermediate piece as proposed in the invention, the effect can be achieved that the time characteristic of the measurement signal of the force sensor in an operating situation in which only a first part of the cover is covered by the belt-shaped material, clearly differs from the time characteristic of the measurement signal of the force sensor in an operating situation in which only a second part of the cover, which is different from the first part, is covered by the band-shaped material, so that from a consideration of the time course it can be determined how much the ribbon-like good covers the cover.

In a preferred embodiment, the measuring roller body has a cutout in which a shaped body is located. In a preferred embodiment, the cutout is adjacent to the recess. In a particularly preferred embodiment, the cutout has a base surface, preferably a flat base surface. In a particularly preferred embodiment, the recess opens into the base of the cutout. In a preferred embodiment, the recess opens into the base surface at a distance from the edge of the base surface, preferably centrally in the base surface of the cutout. In a preferred embodiment, the recess extends further into the measuring roller body starting at the base of the recess, preferably radially further into the measuring roller body.

In a preferred embodiment, the molded body is fixed in the cutout, preferably screwed and/or glued.

In a preferred embodiment in which the recess opens into the base of the cutout, the cover that at least partially closes the recess is disposed in the recess and has an outer surface that is aligned with the base of the cutout. In an alternative embodiment, in which the recess opens into the base surface of the cutout, the cover at least partially closing the recess has an outer surface which, viewed in the radial direction of the measuring roller, is designed further outside than the base surface of the cutout. In such an embodiment, the cover may be disposed entirely above and outside the recess or may extend from the recess into the cutout. In such an embodiment, the outer surface of the cover may be aligned with the circumferential surface of the measuring roller body and/or aligned with an outer surface of a molded body disposed in the cutout. An embodiment is also possible in which the measuring roller body comprises a measuring roller body half and a cover applied to the measuring roller body half, and the outer surface of the cover is made flush with the peripheral surface of the measuring roller body half and/or flush with an outer surface of a molded body disposed in the cutout.

A cover arranged at least partially above the recess in the cutout can be smaller in its dimensions perpendicular to a radial of the measuring roller body leading through the cover, preferably leading centrally through the cover, in the parts arranged above the recess and in the cutout than the dimensions, pointing in the same directions, of the opening of the recess with which the recess opens into the base surface of the cutout. In an alternative embodiment, the portion of the cover disposed outside of the recess but within the cutout overhangs the opening of the recess with which the recess opens into the base of the cutout in at least one direction, preferably in two opposite directions, preferably in more than two directions. In a preferred embodiment, when the cover is arranged exclusively in the cutout, the cover is not round. In a preferred embodiment in which the cover is arranged partly in the recess and partly in the cutout, preferably the part of the cover arranged in the cutout is not round.

In a preferred embodiment, two molded bodies are arranged in the cutout. In a preferred embodiment, the existing moldings fill the cutout or, in the case of an existing cover extending into the space of the cutout, fill the space of the cutout that remains. In a preferred embodiment, the respective molded body has an outer surface that is aligned with the circumferential surface of the measuring roller body or a circumferential surface of a measuring roller body semi-finished product, for example complementing the circumferential surface to form a closed cylinder surface.

In a preferred embodiment, the recess opens into the base of the cutout and a single molded body is disposed in the cutout, the molded body having a punch formed in the molded body and disposed above the cover, preferably in contact with the cover. In a preferred embodiment, the punch is made by a free cut, preferably an annular free cut in the molded body.

In a preferred embodiment, the cover is made in one piece with the molded body. The molded body may have a punch formed in the molded body that projects into the recess from above the recess and is in contact with the force sensor located in the recess. In a preferred embodiment, portions of the punch are exposed by a clearance cut within the molded body, preferably by means of an annular clearance cut.

In a preferred embodiment, the molded body overlaps with a recess that opens into a base of the cutout. In a preferred embodiment, the molded body overlaps only slightly with the recess. In a preferred embodiment, the area of the molded body with which the molded body overlaps the recess corresponds to less than 30%, more preferably less than 20%, in particular less than 10% of the area with which the recess opens into the base surface of the cutout (the area of the opening of the recess in the base surface).

In a preferred embodiment, the molded body and/or the cover is designed as a layered coating, preferably as an independent component that is produced as a layered coating, for example by means of 3D printing.

According to the invention, the cover at least partially closes the recess. In a preferred embodiment, the cover at least partially closes the recess in that the cover is at least partially, preferably entirely, disposed in the recess. The cover is preferably arranged with a circumferential gap in the recess. Preferably, the shape of the recess corresponds to the cover.

Preferably, at least in the area of its opening provided at the radially outer end of the recess, the recess is designed in such a way that

- the opening has a geometric shape which is mirror-symmetrical with respect to a plane of symmetry containing the axis of rotation, but whose geometric shape is not mirror-symmetrical with respect to planes perpendicular to the axis of rotation
  or
- the opening has a geometrical shape which is mirror-symmetrical with respect to a plane of symmetry perpendicular to the axis of rotation, but whose geometrical shape is not mirror-symmetrical with respect to planes containing the axis of rotation
  or
- the opening has a geometrical shape which is not mirror symmetrical with respect to planes perpendicular to the axis of rotation, as well as with respect to planes containing the axis of rotation.

However, "at least partially closing the recess" and the phrase that the cover "at least partially closes the recess" is understood to mean any embodiment in which the cover at least partially overlaps with the recess, in particular with the opening provided at the radially outer end of the recess, in a viewing direction along a radial of the measuring roller body. This is achieved with covers that are located in the recess. However, this is also achieved in the case of covers which are arranged outside the recess and above the recess, for example are arranged in a cutout of the measuring roller body, and are shaped and positioned in such a way that the cover thus shaped and positioned overlaps at least partially with the recess, in particular with the opening provided at the radially outer end of the recess, in a viewing direction along a radial of the measuring roller body.

The cover may be the beam described above, located in the recess and extending along a longitudinal axis. However, embodiments are also possible in which the cover is arranged outside the recess. In a preferred embodiment, these embodiments include an intermediate piece disposed between the cover and the force sensor. Preferably, at least in one operating situation, the intermediate piece has one end in contact with the cover and an opposite end in contact with the force sensor. The intermediate piece can transmit compressive forces exerted on the cover to the force sensor.

The shape, in particular the cross-sectional shape of the intermediate piece, can be adapted to the shape, in particular the cross-sectional shape of the cover and can take up asymmetrical shapes, in particular an asymmetrical cross-sectional shape of the cover. Embodiments are also possible in which the shape, in particular the cross-sectional shape, of the intermediate piece deviates from a shape, in particular the cross-sectional shape, of the force sensor. For example, the cover may have an asymmetrical cross-sectional shape and the intermediate piece and force sensor may have a symmetrical cross-sectional shape.

The shape, in particular the cross-sectional shape of the intermediate piece, can also be adapted to the shape, in particular the cross-sectional shape of the force sensor and pick up asymmetrical shapes, in particular an asymmetrical cross-sectional shape of the force sensor. Embodiments are also possible in which the shape, in particular the cross-sectional shape, of the intermediate piece deviates from a shape, in particular the cross-sectional shape, of the cover. For example, the intermediate piece and the force sensor may have an asymmetrical cross-sectional shape and the cover may have a symmetrical cross-sectional shape.

Finally, embodiments are also possible in which the intermediate piece has a shape, in particular a cross-sectional shape, that is different from the cross-sectional shape of the cover and different from the cross-sectional shape of the force sensor. For example, the intermediate piece may have an asymmetrical cross-sectional shape and the cover and force sensor may have a symmetrical cross-sectional shape.

The aforementioned cross-sectional shape to the aforementioned embodiments refers in particular to the respective cross-sectional shape in a plane perpendicular to a radial of the measuring roller body.

In a preferred embodiment, the intermediate piece is an independent element. However, embodiments are also conceivable in which the intermediate piece is part of the body forming the cover. For example, an embodiment is possible in which a body has an upper part whose cross-sectional shape is circular and which acts as a cover, the body having a lower part forming an intermediate piece whose cross-sectional shape is thus asymmetrical. In a preferred embodiment, there is provided a body having an upper portion which functions as a cover, the body having a lower portion which forms an intermediate piece, the cross-sectional shape of which is formed asymmetrically such that an outer surface of the intermediate piece facing the force sensor is provided, the geometric shape of which is designed to be mirror-symmetrical with respect to a plane of symmetry containing the axis of rotation, but the geometric shape of which is not designed to be mirror-symmetrical with respect to planes perpendicular to the axis of rotation or an outer surface of the intermediate piece facing the force sensor is provided, the geometric shape of which is mirror-symmetrical with respect to a plane of symmetry running perpendicular to the axis of rotation, but the geometric shape of which is not mirror-symmetrical with respect to planes containing the axis of rotation or an outer surface of the intermediate piece facing the force sensor is provided, the geometric shape of which is not mirror-symmetrical both with respect to planes perpendicular to the axis of rotation and with respect to planes containing the axis of rotation.

A "layer application" within the meaning of the description comprises a material application by means of which a layer, in particular of metal, can initially be applied in a point-by-point, line-by-line or column-by-column and/or grid-by-grid manner in order to form a three-dimensional object in the form of a layer or several layers one above the other. During layer application, the layer that is currently being applied can be firmly bonded to an underlying layer or to the measuring roller body, if the layer is the first to be applied to the measuring roller body. The material can be applied in layers by computer control from one or more liquid or solid materials according to specified dimensions and shapes. Physical or chemical curing or melting processes can take place during material application. By means of the layer application, a closed essentially smooth surface can be produced. The coating application may consist of a single layer. A single layer can be created by applying it once dot by dot, line by line or column by column, and/or grid by grid. In such a structure, once a first layer has been created, no further layer is applied dot-wise, line-wise or column-wise and/or grid-wise. In a preferred embodiment, however, the layered structure comprises several layers, preferably produced one after the other. Point-by-point" is understood to mean the application of a layer or part of a layer with an operation that does not involve relative movements along the circumferential surface of the measuring roller body. The term "dot-wise" is not to be understood as a limitation on the size of the layer, or the part of the layer, that is applied with this operation. "Dot-wise" can also mean the application of a large-area layer or a large-area part of a layer, as long as this step is possible without relative movements along the circumferential surface of the measuring roller body.

In a preferred embodiment, the coating is applied by means of printing with a 3D printer, laser beam melting (LBM), electron beam melting (EBM), laser powder buildup welding, arc welding with wire feed, thermal spraying, buildup welding, wire laser buildup welding, powder bedding, in particular preferably the so-called "Selective Laser Sintering" (SLS) or the so-called "Selective Laser Melting" (SLM), laser metal deposition (LMD), extreme high-speed laser deposition (LMD), or extreme high-speed laser sintering. "Selective Laser Sintering" (SLS) or "Selective Laser Melting" (SLM), Laser Metal Deposition (LMD), Extreme High Speed Laser Cladding (EHLA) and/or build-up soldering. This makes it possible to apply layers by means of additive manufacturing based on 3D models. To the extent that examples of layered deposition manufacturing are provided, such 3D model-based additive manufacturing includes free-jet binder deposition, directed energy material deposition, material extrusion, free-jet material deposition, powder bed-based melting, layered lamination, bath-based photopolymerization, and combinations of the foregoing. The recess alone or the recess with the cover or the beam and the force sensor can thus be at least partially closed, preferably completely closed. The aforementioned methods offer the advantage that a material feed for the coating application can be moved over the measuring roller body with the aid of linear axes or a robot. A mix of materials or essentially a pure material can be used here. The generation of a melt is possible. In particular, the laser or electron beam can be used to generate a melt of the supplied material, which is applied to the measuring roller body or to layers already present above the measuring roller body. It can be provided that the material for coating application is conveyed as powder with a protective gas flow or by means of wire feed into the area in which a material melt is generated. In particular, a joining principle can be carried out by means of the aforementioned processes, which is in particular fusion welding. A material closure is possible through this.

In a preferred embodiment, the coating application comprises at least one weldable metal, at least one weldable alloy, and/or ceramic reinforcing particles. By a suitable choice of the material for the coating application, the requirements for the measuring roller can be met and/or a good thermal stability with good manufacturing possibilities can be considered at the same time. Metals with high strength and toughness are particularly preferred. Particularly preferred are iron, cobalt, nickel, chromium, molybdenum, vanadium and alloys thereof, for example a chromium-molybdenum alloy (CrMo), for example 42CrMo4, or a chromium-molybdenum-vanadium alloy (CrMoVa), for example 86CrMoV7, or for example a tungsten-nickel-chromium alloy (WCNiCr).

In a preferred embodiment, the coating application has layers of different compositions on top of each other, so that different requirements for the layers with regard to their position on the measuring roller body can be taken into account. For example, the layer or multiple layers directly over the recess may be formed with the same material, which in particular may be the same or similar material as the material for the measuring roller body. One or more layers above the layer of the coating application, which are located directly above the recess, can be formed by means of a high-wear material. Silicon carbide, tungsten carbide, titanium carbide, tantalum carbide and/or chromium carbide are particularly preferred.

In a preferred embodiment, the measuring roller body is designed as a layered structure.

The measuring roller according to the invention has a measuring roller body. Preferably, the measuring pulley body has a closed circumferential surface. In a preferred embodiment, the measuring pulley body is a solid pulley extending along a longitudinal axis. A solid pulley is understood to be a measuring pulley body which is in one piece and its shape has been produced either by a primary forming process, for example casting, and/or its geometric shape is produced from a one-piece semi-finished product by cutting processes, in particular by machining, especially by turning, drilling, milling or grinding. In a preferred embodiment, in such a measuring pulley body designed as a solid pulley, the measuring pulley pivots arranged in each case on the end face of the measuring pulley for rotatable mounting of the measuring pulley, for example in ball bearings, are also part of the one-piece body. However, designs such as are illustrated, for example, in FIG. 2 of DE 20 2014 006 820 U1 are also conceivable, in which the main part of the measuring roller body is designed as a cylindrical solid roller which has covers arranged on the end faces, on which the measuring roller journals are embodied. Furthermore, the measuring roller body according to the invention can be designed, for example, like the measuring roller body embodied in FIG. 3 of DE 20 2014 006 820 U1, in which the measuring roller body is formed with integrally formed journals and a casing tube is slid over the measuring roller body. In a particularly preferred embodiment, however, the measuring pulley does not have a sheath tube, but is designed as a solid pulley. Embodiments are conceivable in which the measuring roller body according to the invention is formed from individual disks arranged next to one another, as is shown, for example, in DE 26 30 410 C2.

At least one recess is provided in the measuring roller body of the measuring roller according to the invention. It has been shown that the advantages of the invention can be achieved with only one cavity in the measuring pulley body. In case of flatness measurement, for example, it will be credible when information about the flatness of the strip-shaped material which is passed over the measuring pulley once per revolution of the measuring pulley.

In a preferred embodiment, the measuring pulley body has multiple cavities. In a preferred embodiment, the cavities are designed at the same radial distance from the longitudinal axis of the measuring pulley body. In a preferred embodiment, all cavities are arranged equidistantly to each other in the circumferential direction. However, embodiments are also conceivable in which a first group of recesses is provided, which are particularly preferably arranged at the same radial distance from the longitudinal axis and distributed equidistantly in the circumferential direction, and in which at least one further recess is provided in addition to this first group of recesses which is either designed differently in terms of its radial distance from the longitudinal axis than the recesses of the first group and/or is not at the same distance from the remaining recesses in the circumferential direction as the remaining recesses have from one another. It is thus conceivable, for example, to design a measuring roller with regard to the flatness measurement in the same way as a measuring roller of the prior art, for example like the solid roller known from DE 102 07 501 or the measuring rollers known from DE 10 2014 012 426 A1, in order to then use these measuring rollers of the prior art for the equipment according to the invention. with a further recess formed outside the grid, by means of which, for example, another measurement is carried out.

In a preferred embodiment, the measuring pulley has bearing pivots. In a preferred embodiment, in embodiments of the measuring roller with end faces, the bearing journals are formed on the end faces.

In a preferred embodiment, the measuring pulley body is cylindrical in shape.

In a preferred embodiment, the force sensor has a sensor surface, where the force sensor can generate a sensor signal when the position of the sensor surface of the force sensor changes. Force sensors are called force sensors because they are used to measure forces, especially preferably compressive forces. In order to measure the force acting on them, the force sensors are designed in such a way that they have a sensor surface and can generate a sensor signal when the position of the sensor surface changes. The force sensors usually have a reference system associated with them and respond to changes in the position of the sensor surface in this reference system. Force sensors often feature a housing. The reference system is then often the housing. For example, in such an embodiment, the force sensor may detect whether the position of the sensor surface has changed relative to the housing. For example, if the force sensor is a piezoelectric force sensor, it includes a piezo-quartz that can generate an electrical signal when the position of one of its surfaces is changed relative to a reference surface, such as an opposing surface of the piezo-quartz, for example, the piezo-quartz is compressed. In the case of a force sensor designed as a strain gauge, a change in the position of the surface of the force sensor changes the length of the measuring wire or the measuring grid formed from measuring wires, usually stretching it, but sometimes also compressing it. In a force sensor designed as an optical force sensor, the optical properties of the force sensor, for example the refractive index or reflection properties, are changed by the change in position of the surface.

The force sensors to be used according to the invention have a sensor surface whose position change is observed by the force sensor to determine a force acting on it. Embodiments are conceivable in which the sensing surface is a surface of the element whose properties are modified to generate the sensing signal, for example, a surface of the piezo-quartz itself. However, such force sensors often have intermediate pieces on which the sensor surface is formed. Often such spacers are rigid blocks where a change in the position of one surface of the rigid block immediately results in a change in the position of the opposite surface due to the rigidity of the block. Such spacers can be used to make the sensor surface protrude from other parts of the force sensor, in particular from a housing. By having a sensor surface that protrudes from other parts of the force sensor, measurement accuracy is increased because a clearly defined area is created on which the environment can act. Protruding sensor surfaces can, for example, prevent measurement errors due to force shunts. The force sensor according to the invention can, for example, be designed like the force sensor shown in DE 1 773 551 A1 and have a piezoelectric element arranged in a housing and consisting of a multilayer crystal arrangement, which is arranged between two force transmission disks. In such an embodiment, the sensor surface would be the outer surface of the upper force transmission disc shown in FIG. 1 of DE 1 773 551 A1 or the outer surface of the lower force transmission disc shown in FIG. 1 of DE 1 773 551 A1.

In a preferred embodiment, the sensor surface is flat. In a preferred embodiment, the surface normal of the flat sensor surface of the force sensor points in the direction of the circumferential surface.

In a preferred embodiment, the surface normal of a planar sensor surface at the point on the sensor surface at which the sensor surface is intersected by a radial of the measuring roller body is at an angle to this radial of the measuring roller body which is less than 45°, more preferably less than 20°, more preferably less than 10°, more preferably less than 5°.

In a preferred embodiment, the sensor surface of a force sensor used in the measuring roller according to the invention is a flat surface.

In a preferred embodiment, the sensor surface is a surface that is highlighted from other elements of the force sensor and is in contact with a cover that closes the recess to the peripheral surface.

In a preferred embodiment, at least two force sensors used in the measuring roller according to the invention, in particular preferably the majority of the force sensors used in the measuring roller according to the invention, in particular preferably all force sensors used in the measuring roller according to the invention are of the same design, i.e. of the same type and in particular of the same series, in particular preferably of identical design.

In a preferred embodiment, the measuring roller has a plurality of force sensors, all of which are arranged in a recess. In particular, more than 5, especially preferably more than 7, more preferably more than 10, especially preferably more than 15 force sensors are arranged in a recess.

The measuring roller according to the invention is preferably used in particular for determining the properties of a metal strip during cold or hot rolling of the metal strip, in particular for determining the flatness of the metal strip. Other applications can include further processing lines, such as re-rolling stands (skin pass stands), strip annealing lines, galvanizing lines, stretch-bend leveling lines.

BRIEF DESCRIPTION OF THE DRAWINGS

The invention is explained in more detail below with reference to examples of embodiments shown in the drawings.

DETAILED DESCRIPTION

Figure 1:
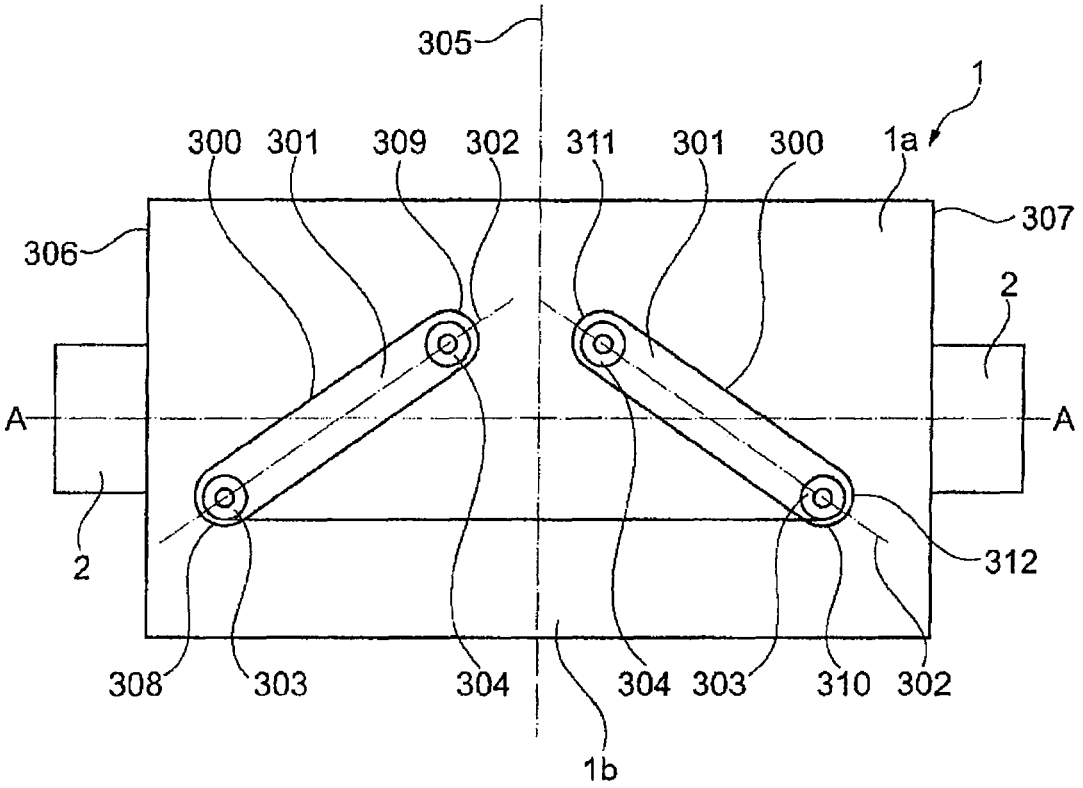
FIG. 1 is a schematic view of a measuring roller to be used according to the invention for determining the strip edge position.

According to FIG. 1, the measuring roller 1 to be used for the strip edge position has journals 2 and has a measuring roller body 1*a* designed as a solid roller. The measuring roller body 1*a* has a rotation axis A, which is also the longitudinal axis A of the measuring roller body 1*a*.

The measuring roller body 1*a* is designed as a cylinder and has a circumferential surface 1*b*. The circumferential surface 1*b* of the cylindrical measuring roller body 1*a* is shown as an unrolled surface in FIG. 2.

The embodiment shown in FIG. 1 has two recesses 300. A beam 301 is disposed in each of the two recesses 300. The respective beam 301 extends along a longitudinal axis 302. In the embodiment shown in FIG. 1, the respective beam 301 is substantially rectangular in shape and has semi-circular ends at its ends, consequently the end faces of this beam 301 are curved surfaces, namely partial surfaces of a cylinder. In the embodiment shown in FIG. 2, the end faces are flat surfaces.

In the embodiment shown in FIG. 1, a first force sensor 303 and a second force sensor 304 are disposed in each recess 300. The respective beam 301 is supported within the recess on the first force sensor 303 and the second force sensor 304. The respective longitudinal axis 302 of the respective beam 301 does not run parallel to the axis of rotation A of the measuring roller body 1*a* and does not run in a plane perpendicular to the axis of rotation A of the measuring roller body 1*a*. The beams 301 run diagonally across the measuring roller body 1*a*.

FIG. 1 shows the center plane 305 of the measuring roller body 1*a*. The center plane 305 is perpendicular to the axis of rotation A of the measuring roller body 1*a* and is located midway between one end 306 of the measuring roller body 1*a* and the second end 307 opposite the first end 306.

The first beam 301 includes a first end 308 and a second end 309 opposite the first end 308, the first end 308 and the second end 309 of the first beam 301 being disposed on one side of the center plane 305. The second beam 301 includes a first end 310 and a second end 311 opposite the first end 310, the first end 310 and the second end 311 of the second beam 301 being disposed on the opposite side of the center plane 305. Neither the first beam 301 nor the second beam 301 cross the center plane. The first beam 301 and the second beam 301 are configured so that

- the first end 308 of the first beam 301 is arranged closer to the first end 306 of the measuring roller body 1*a* than to the center plane 305,
- the second end 309 of the first beam 301 is arranged closer to the center plane 305 than the first end 308 of the measuring roller body 1*a*,
- the first end 310 of the second beam 301 is arranged closer to the second end 307 of the measuring roller body 1*a* than to the center plane 305,
- the second end 311 of the second beam 301 is disposed closer to the center plane 305 than the first end 310,
- the first end 308 of the first beam 301 and the first end 310 of the second beam 310 are arranged on a line 312 that is parallel to the axis of rotation A of the measuring roller body 1*a*.

The first beam 301 and the second beam 301 are mirror symmetrical with respect to the center plane 305.

Figure 3:
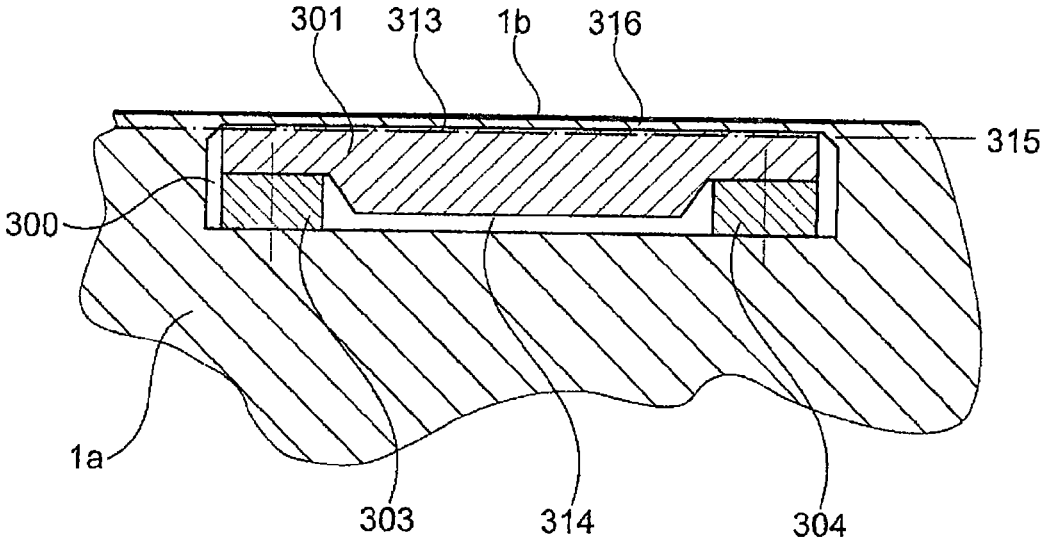
FIG. 3 is a schematic sectional drawing through a part of the measuring roller and a recess made in the measuring roller body with beams and first force sensor and second force sensor arranged in the recess.

FIG. 3 shows that the beam 301 has a top surface 313 and a bottom surface 314. The upper side 313 is arranged radially further out than the lower side 314. The top surface is arranged in a curved surface 315, which is cylindrical and parallel to the cylindrical peripheral surface 1*b* of the measuring roller body 1*a*.

FIG. 3 shows a coating application 316 that was applied from above to the top surface 313 of the beam 301. The layer application 316 closes the recess 300 and creates a closed circumferential surface 1*b* of the measuring roller body 1*a*. The 316 layer coating can be produced by additive manufacturing processes. The 316 overlay can be produced by buildup welding. The layered coating 316 can be produced in the course of 3D printing, in particular preferably 3D printing of the entire measuring roller body 1*a*.

Figure 12:
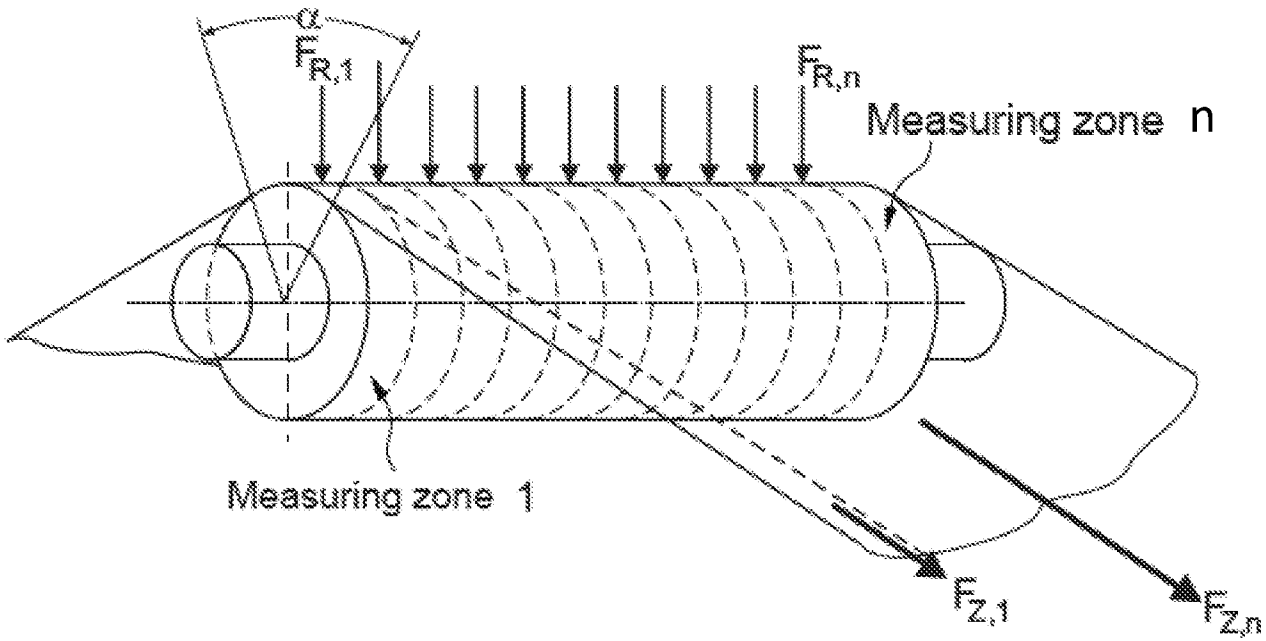
FIG. 12 is a schematic representation of the forces acting on a measuring pulley.

To determine the position of the strip edge 317 of the strip-shaped material 318 (the strip 318), the strip 318 is guided over the measuring roller 1 in such a way that it surrounds it with a wrap angle ALPHA (cf. FIG. 12). The movement of the belt 318 causes the measuring roller 1 to rotate about the axis of rotation A. In addition, a drive can be provided to support the rotation of the measuring roller 1 about the axis of rotation.

Figure 2:
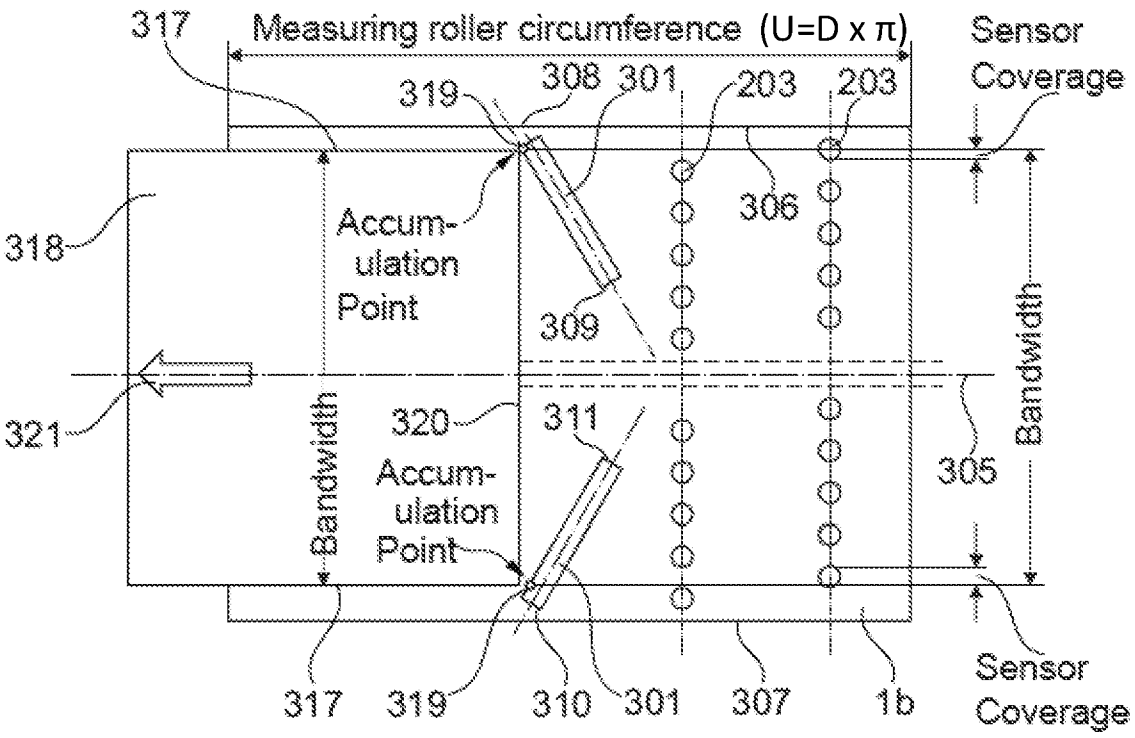
FIG. 2 is a schematic representation of the circumferential surface of the measuring roller body of the measuring roller unwound into a plane and of the strip-shaped material running over this circumferential surface.
Figure 4:
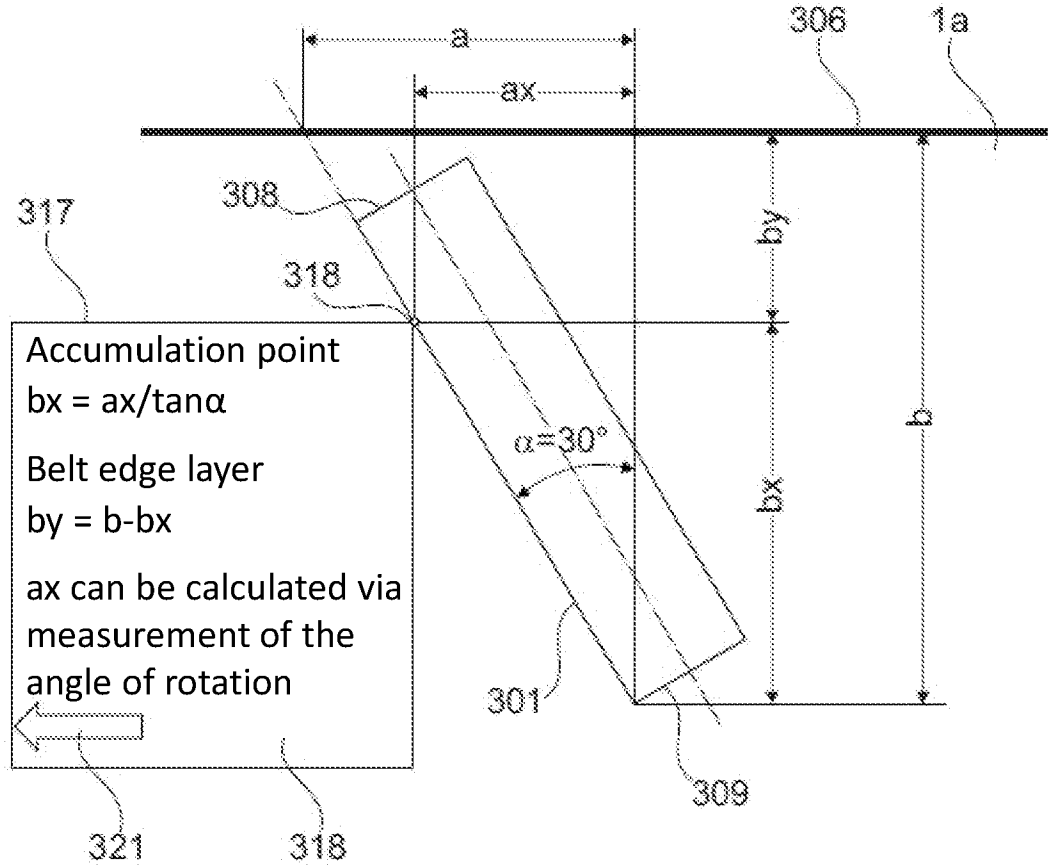
FIG. 4 is a section of the illustration according to FIG. 2.

In FIG. 2 and FIG. 4, the belt 318 is partially shown. For clarity, the tape 318 has been cut at the line where the tape 318 first comes into contact with the first beam 301 (the run-up point 319). In reality, the tape 318 extends from the cut edge 320 even further to the right in FIGS. 2 and 4. The tape 318 is moved in the direction of the arrow 321 over the measuring roller 1. This movement causes the belt 318 to rotate the measuring roller 1 also in the direction of the arrow 321. By rotating the measuring roller 1, the first bar 301 and the second bar 301 are brought into contact with the tape 318 once per revolution of the measuring roller 1. Due to the oblique position of the beams 301, the position of the point at which the respective beam 301 first makes contact with the belt 318 per revolution (the respective run-up point 319) depends on the position of the belt edge 317 relative to the center plane 305 or on the position of the belt edge 317 relative to the first end 306 or on the position of the belt edge 317 relative to the second end 307. In the operating situation shown in FIGS. 2 and 4, the upper belt edge 317 is further away from the center plane 305 than the lower belt edge 317. The distance of the upper band edge 317 to the first end 306 of the measuring roller body 1*a* is smaller than the distance of the lower band edge 317 to the second end 307 of the measuring roller body 1*a*. Therefore, the distance from the point of contact 319 of the upper edge 317 of the band on the first beam 301 to the first end 308 of the first beam 301 is less than the distance from the point of contact 319 of the lower edge 317 of the band on the second beam 301 to the first end 310 of the second beam 301. In the operating situation shown in FIGS. 2 and 4, the upper belt edge 317 has just run onto the first beam 301, while the lower belt edge 317 has not yet run onto the second beam 301. The force sensors on which the first beam 301 is supported already give a signal. The force sensors on which the second beam 301 is supported do not yet give a signal.

FIG. 4 shows that the distance of the tape edge 317 from the first end 306 of the measuring roller 1 is given by the formula $$by=b-(ax/\tan(BETA))$$

can be calculated, where

- b=axial distance of the point of the second end 309 of the beam 301 closest to the center plane 305;
- ax=distance in circumferential direction between the point of the second end 309 of the beam 301 closest to the center plane 305 and the run-up point 319 (first deflection of the measuring signal);
- BETA=angle between roller axis and beam.

The distance ax can be determined via a rotary encoder. The encoder can also be used to resolve the signal from the force sensor in relation to the angle of rotation. This makes it possible to determine at which angle of rotation the initial deflection of the force sensor signal occurs. If, for example, the distance ax at which the angle of rotation is present is stored in a table, the value ax can be determined from monitoring the signal of the force sensor in relation to the angle of rotation. If the initial deflection of the signal is determined and output at which angle of rotation the initial deflection occurs, the value ax associated for this angle of rotation can be determined via the angle of rotation and an assignment table between angle of rotation and ax.

FIG. 1 shows that the measuring roller alone can be designed to determine the strip edge position and with it—if desired—the strip width. For such an application, the measuring roller 1 is only equipped with two beams 301.

FIG. 2 shows that the beams 301 to be used for determining the strip edge position can be combined with further force sensors in further recesses, which can be used for determining flatness, for example. Thus, FIG. 2 shows a first row of recesses 203 and a second row of recesses 203.

In the embodiment shown in FIGS. 1, 2, the cover designed as a beam 301 is designed to have an outer surface whose geometric shape is designed to be non-mirror symmetrical both with respect to planes that are perpendicular to the axis of rotation A and with respect to planes that contain the axis of rotation A. The outer surface of the cover is designed to have a geometric shape that is not mirror symmetrical.

Figure 5:
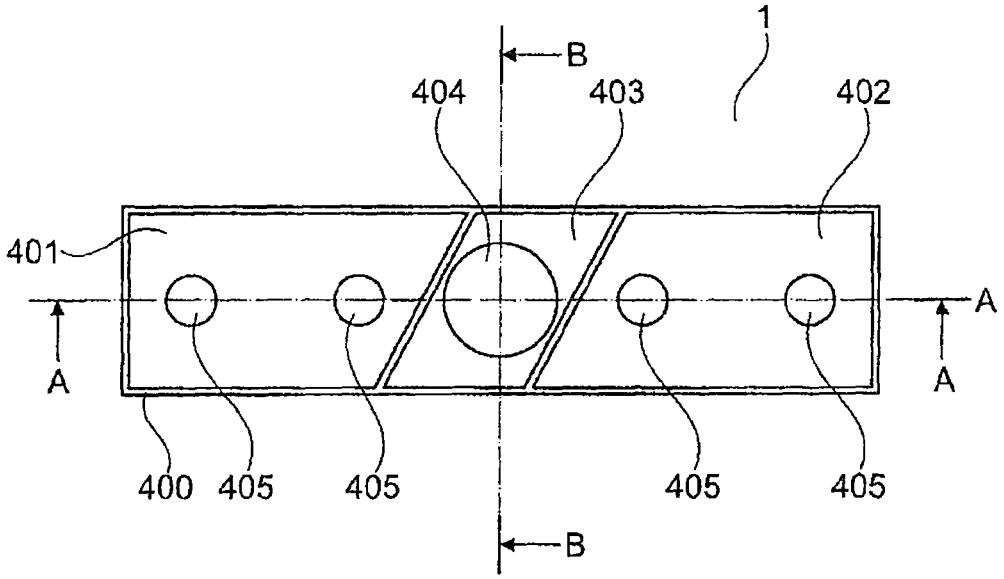
FIG. 5 is a plan view of a portion of the circumferential surface of a measuring roller according to the invention.

FIG. 5 shows a top layer on a part of the outer surface of a measuring roller 1 according to the invention. The measuring roller 1 has a cutout 400. Two molded bodies 401 and 402 and a cover 403 are disposed in the cutout 400. The cover 403 has a trapezoidal cross-sectional shape in the plan view of FIG. 5, which corresponds to a plan view along a radial of the measuring roller body 1*a*. The cover is held by a clamping screw 404. The molded bodies 401, 402 are held in place by fastening screws 405. In FIG. 5, the axis of rotation A of the measuring roller body 1*a* is drawn. FIG. 5 shows that the cover 403 is configured so that the cover 403 has an outer surface whose geometric shape is not mirror-symmetrical with respect to planes perpendicular to the axis of rotation A, as well as with respect to planes containing the axis of rotation A.

Figure 6:
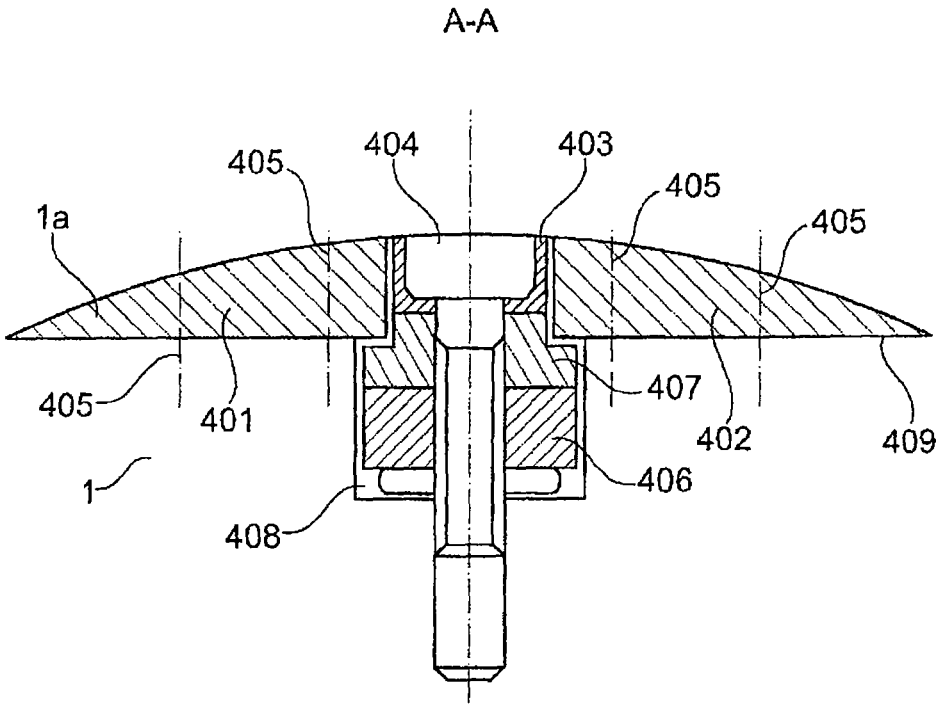
FIG. 6 is a sectional view of a part of the measuring roller according to the invention along section line A-A in FIG. 5.
Figure 7:
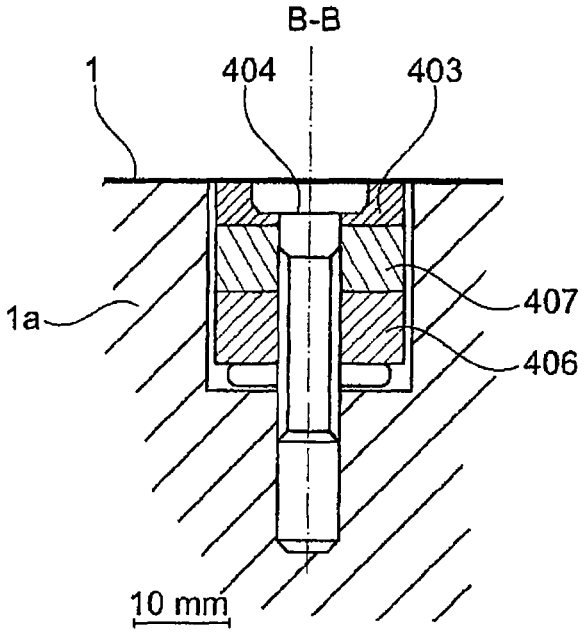
FIG. 7 is a sectional view of a part of the measuring roller according to the invention along the line of intersection B-B in FIG. 5.

FIGS. 6, 7 show that an intermediate piece 407 is arranged between the cover 403 and the force sensor 406. The intermediate piece 407 is stepped, but is symmetrical in cross-sections perpendicular to the longitudinal axis of the fastening screw 404, namely round. The force sensor 406 is circular around the longitudinal axis of the mounting screw 404.

FIG. 6 shows that the molded bodies 401, 402 overhang the recess 408 in the measuring roller body 1*a*.

The cutout 400 in the measuring roller body 1*a* has a flat base 409.

Figure 8:
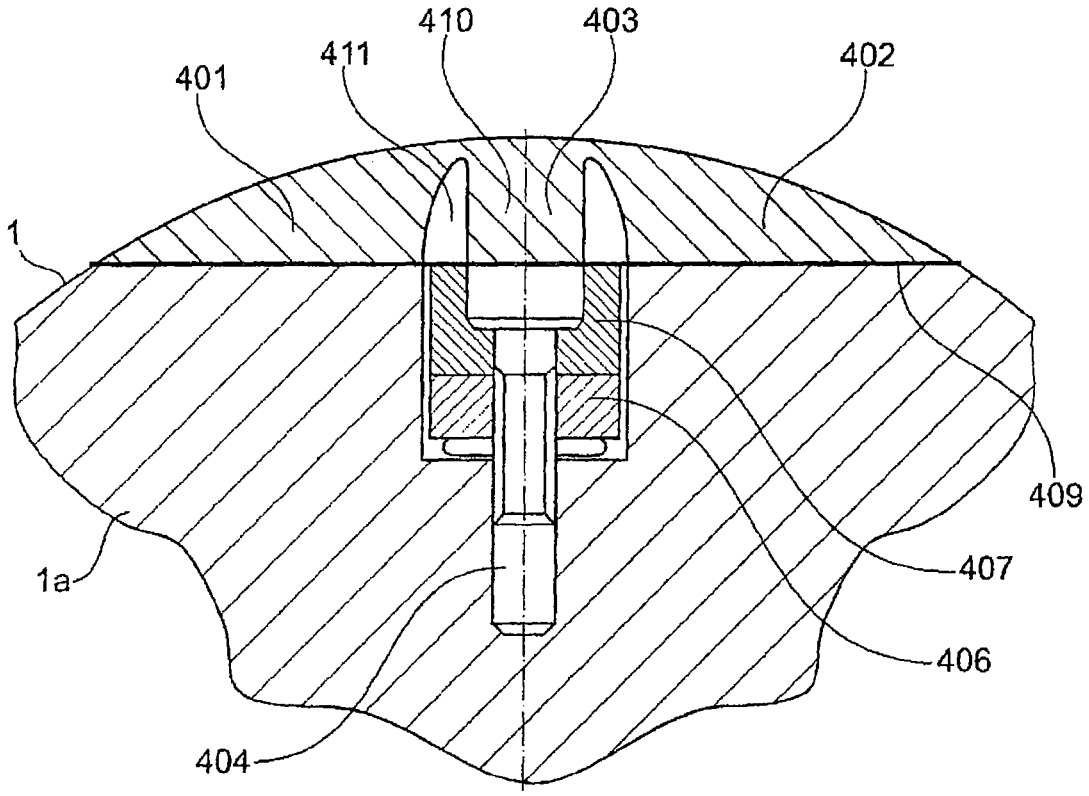
FIG. 8 is a sectional view, comparable to the view according to FIG. 6, of a part of a further embodiment of a measuring roller according to the invention.

FIG. 8 shows that the cover 403 and the molded bodies 401, 402 can be part of a one-piece body. A punch 410 embodied in the body may be provided, which is disposed above the intermediate member 407, preferably in contact with the intermediate member 407. The punch 410 is made by an annular free cut 411 in the body.

Figure 9:
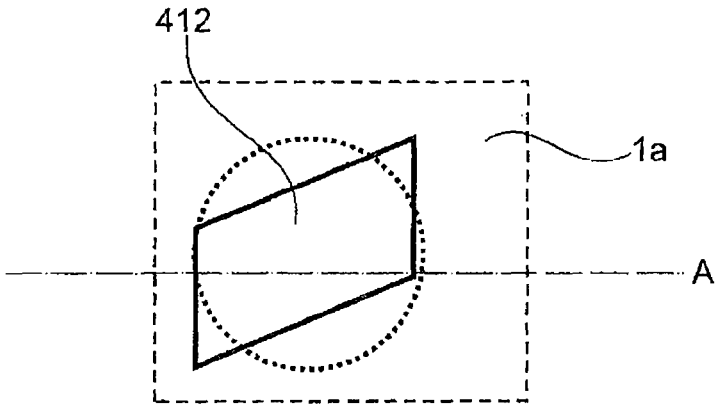
FIG. 9 is a schematic top view of a force sensor of a measuring roller.

FIG. 9 shows a top view of a force sensor 412 arranged in a similarly shaped recess in the measuring roller body 1*a*, which is not shown in detail. The axis of rotation A is shown in FIG. 9. FIG. 9 shows a design in which the force sensor 412 has an outer surface whose geometric shape is not mirror-symmetrical with respect to planes perpendicular to the axis of rotation as well as with respect to planes containing the axis of rotation.

Figure 10:
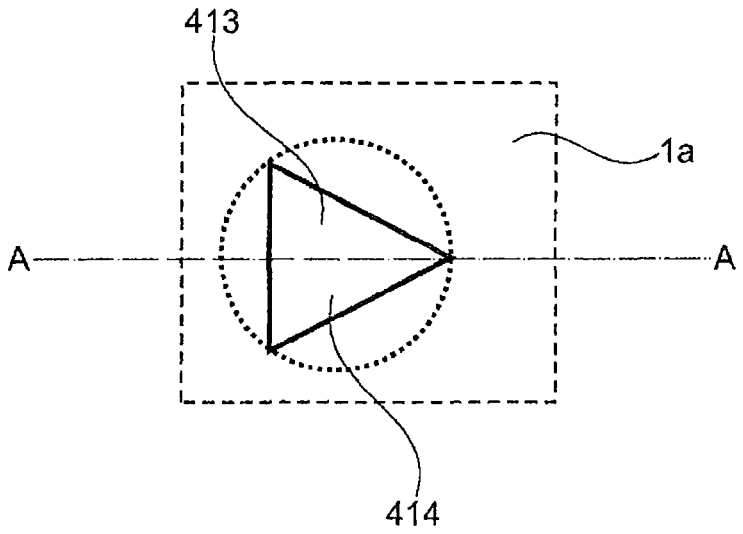
FIG. 10 is a schematic top view of an intermediate piece and a force sensor of a measuring roller.

FIG. 10 shows a top view of a (dash-dotted, circular) force sensor 413, which is arranged in an identically shaped recess in the measuring roller body 1*a* that is not shown in greater detail. An intermediate piece 414 is provided above the force sensor 413 and below a cover (not shown in FIG. 10). The axis of rotation A is shown in FIG. 10. FIG. 10 shows a design in which the intermediate piece 414 arranged between the cover and the force sensor 413 has an outer surface whose geometric shape is designed to be mirror-symmetrical with respect to a plane of symmetry containing the axis of rotation A, but whose geometric shape is not designed to be mirror-symmetrical with respect to planes that are perpendicular to the axis of rotation A.

Figure 11:
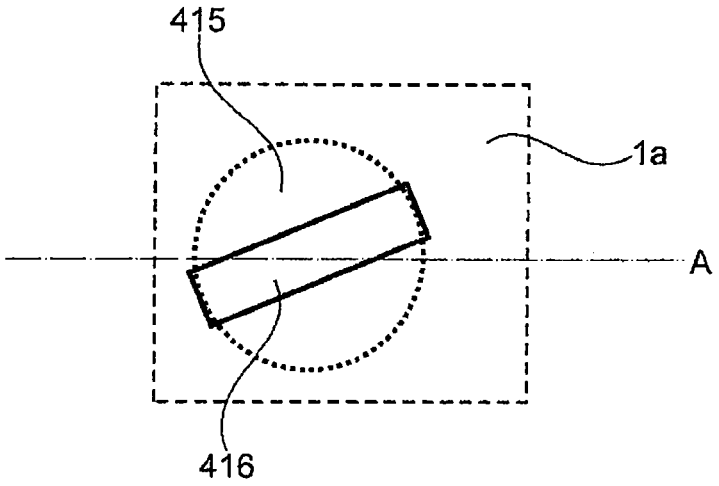
FIG. 11 is a schematic top view of an intermediate piece and a force sensor of a measuring roller.

FIG. 11 shows a top view of a (dash-dotted, circular) force sensor 415 arranged in an identically shaped recess in the measuring roller body 1*a*, which is not shown in greater detail. An intermediate piece 416 is provided above the force sensor 415 and below a cover (not shown in FIG. 10). The axis of rotation A is shown in FIG. 11. FIG. 11 shows a design in which the intermediate piece 416 arranged between the cover and the force sensor 415 has an outer surface whose geometric shape is not mirror-symmetrical both with respect to planes which are perpendicular to the axis of rotation A and with respect to planes which contain the axis of rotation A.

FIG. 12 shows the forces applied to the measuring roller 1 by a metal strip which partially wraps around the measuring roller 1 and is under strip tension. The quartz force sensors arranged in recesses in the measuring roller 1 generate an electric charge. This is directly proportional to the force applied to the quartz.

The strip length deviation, usually measured in I-units and commonly used as a representative of strip flatness, can be calculated based on the following relationships:

Local Radial Force in N

FR,i

Local tensile force in $N$ $FZ,i=FR,i/(2\times\sin\alpha/2)$ $\alpha$=tape deflection angle around measuring roller Local tensile stress in N/mm2 $\sigma_{Z,i}=FZ,i/(bEl\times d)$ bEl=measuring zone width d=strip thickness Tensile stress deviation in N/mm2 $\Delta\sigma_{Z,i}=\sigma_{Z,max}-\sigma_{Z,i}$ $\sigma$ Z,max=maximum local tensile stress Strip Length Deviation in μm/m $\Delta L/Li=(\Delta\sigma_{Z,i/E})\times 106$ $E$=$E$-module ($E$-steel=2.06×105 N/mm2)

Strip length deviation in I-unit $\Delta L/Li=(\Delta\sigma_{Z,i/E})\times 105$ $E$=$E$-module ($E$-steel=2.06×105 N/mm2)

Example

Quartz force sensor: Sensitivity=4.2 pC/N

Charge at the sensor: =210 pC

Force on the sensor: FR,i=50 N

FZ,i=50/(2×0.342/2)=146, 19 N $\alpha$=20° $\sigma$ Z,i=146, 19/(25×0.5)=11, 6 9 N/mm2 bEl=25 mm, d=0.5 mm $\Delta\sigma$ Z,i=20−11.69=8.3 N/mm2 $\sigma$ Z,max=20 N/mm2

ΔL/Li=(Δ$\sigma$ Z,i/E)×106=162.34 μm/m E=E-modulus (E-steel=2.06×105 N/mm2)

ΔL/Li=(Δ$\sigma$ Z,i/E)×105=16,234 I-Unit.

The invention claimed is:

1. A measuring roller for determining strip edge position and flatness of a strip-shaped material, passed over the measuring roller, comprising a measuring roller body with a circumferential surface, at least one first recess in the measuring roller body, the first recess having a first cross-sectional shape, at least one beam disposed in the first recess and extending along a longitudinal axis, and a force sensor arranged in the recess wherein, the beam is supported within the first recess on the force sensor, and where the measuring roller body extends along an axis of rotation (A) and the longitudinal axis of the beam does not run parallel to the axis of rotation (A) of the measuring roller body and the longitudinal axis of the beam does not run in a plane which is perpendicular to the axis of rotation (A) of the measuring roller body, and wherein multiple further recesses are arranged in the measuring roller body, a second force sensor being arranged in each of the further recesses, each of the further recesses having a second cross-sectional shape which is different from the first cross-sectional shape of the first recess; wherein the second cross-sectional shape of the further recess is circular; wherein the multiple further recesses are arranged in a first row of recesses and a second row of recesses, wherein the first row of recesses and the second row of recesses each extend parallel to the axis of rotation (A) of the measuring roller body and, wherein the further recesses of the first row of recesses are arranged offset to the further recesses of the second row of recesses in a direction along the axis of rotation (A) of the measuring roller body, such that when looking along the circumferential surface of the measuring roller body in a direction transverse to the axis of rotation (A) one of the further recesses of the first row of recesses is located between two adjacent further recesses of the second row of recesses.

* * * * *